US005810539A

United States Patent [19]

Zhang et al.

[11] Patent Number: 5,810,539

[45] **Date of Patent: *Sep. 22, 1998**

[54] MAXIMUM AUTO-PARKING DEVICE

[76] Inventors: Ruyu Zhang; Qing Zhang, both of 43-23 Smart St., Flushing, N.Y. 11355

[ * ] Notice: This patent issued on a continued prosecution application filed under 37 CFR 1.53(d), and is subject to the twenty year patent term provisions of 35 U.S.C. 154(a)(2).

[21] Appl. No.: 628,527

[22] Filed: Apr. 5, 1996

[51] Int. Cl.[6] ..... E04H 6/12

[52] U.S. Cl. ..... 414/239; 414/234

[58] Field of Search ..... 414/234–236, 414/239–243, 259–260, 261, 264

[56] References Cited

U.S. PATENT DOCUMENTS

| | | | |
|---|---|---|---|
| 2,303,656 | 12/1942 | Orr | 414/234 X |
| 2,864,515 | 12/1958 | Marshall | 414/234 |
| 3,079,015 | 2/1963 | Sinclair | 414/239 |
| 3,131,820 | 5/1964 | Creedon | 414/243 |
| 3,675,799 | 7/1972 | Steed et al. | 414/264 X |
| 4,167,365 | 9/1979 | Constantinescu | 414/239 |
| 5,281,069 | 1/1994 | Tsujimoto | 414/239 X |
| 5,304,026 | 4/1994 | Liaw et al. | 414/264 X |
| 5,328,315 | 7/1994 | Sakamoto et al. | 414/236 |
| 5,487,636 | 1/1996 | Mkrtchyan | 414/261 X |

FOREIGN PATENT DOCUMENTS

| | | | |
|---|---|---|---|
| 1414325 | 9/1965 | France | 414/239 |
| 4028592 | 3/1992 | Germany | 414/234 |
| 4353174 | 12/1992 | Japan | 414/239 |
| 2180827 | 4/1987 | United Kingdom | 414/239 |
| 9110794 | 7/1991 | WIPO | 414/240 |
| 9112395 | 8/1991 | WIPO | 414/241 |

*Primary Examiner*—James W. Keenan
*Attorney, Agent, or Firm*—Kathleen M. Harleston

[57] ABSTRACT

A device for the efficient parking of vehicles is provided. The device includes: 1) a car-pan comprised of steel plate; 2) strengthening rods on the car-pan; 3) a parking space frame comprising a pair of steel C bars as its side beams and another pair of steel C bars as its end beams; 4) a number of (preferably two set) of free rollers with supports; 5) two pairs of driving rollers; 6) a parking power/control box affixed between the two side beams of the parking space; 7) chains connecting the driving rollers with the parking power/control box; 8) an elevator; 9) vertical rack-rails located at the two sides of the elevator; 10) an elevator power/control box affixed between the two side beams of the elevator; and 11) two pairs of chains connecting the driving rollers and the climbing gears of the elevator power/control box. The present device may further include 12) four cables with connectors, and 13) two balance weights between the vertical rack-rails.

14 Claims, 16 Drawing Sheets

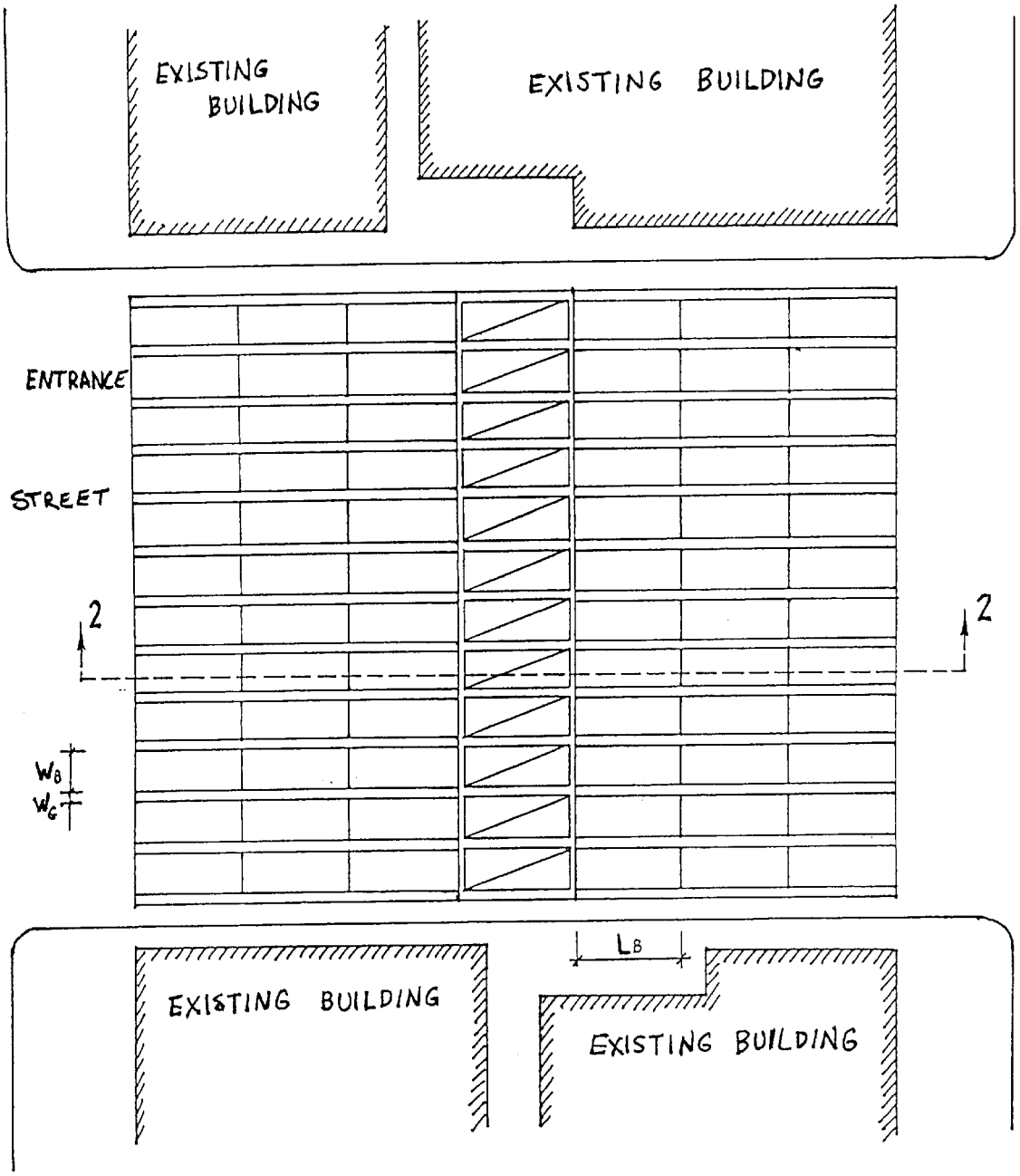
FIG. 1
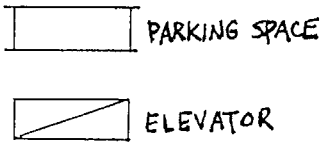

(Section 2-2 of Fig. 1)

MAXIMUM AUTO-PARKING DEVICE

BACKGROUND OF THE INVENTION

References of this invention: Our urban areas are suffering from an over-abundance of automobiles. Many people are therefore seeking an easier, quicker way to park their vehicles in public parking lots. These facilities can house as many cars as possible in a limited amount of space.

The traditional multistory parking lot: The traditional multistory parking lot is usually housed in an independent public building or in an underground portion of a larger building. Our years of experience demonstrate that this arrangement has several shortcomings, which include the following.

1. Low efficiency in the utilization of the area: Most current traditional, or multistory, parking buildings must allocate space for the following four elements: parking spaces, driveways, ramps between stories, and elevators/stairways for people. Under most circumstances, there are still some "dead comers" within the parking area. Actually, the area directly used for parking is usually one half of the total floor space available, or even less.

2. Low efficiency in the utilization of space: Parking facilities must maintain a greater height in each story than is required for the storage of vehicles; this is necessary to accommodate customers who must travel in and out of the facility. For most sedans, the height of the story is sufficient to park two sedans, one over the other. Also, current multistory parking buildings cannot be designed to exceed six stories because nobody enjoys driving in so many circles looking for an uncertain parking space.

3. Waste of customers' time: Most drivers share the following experience: You drive into a public parking building, traveling through many levels on narrow driveways and ramps, and avoiding columns and walls. You are worrying about collisions, waiting for other cars to leave. Finally you find an empty parking space. After parking, you must walk down or use the elevator to exit. If you cannot find a parking space, you must drive down, story by story, and look for parking elsewhere. A car elevator can help customers to go up and down. During rush hours, though, customers on different stories are delayed as they wait for the same elevator.

4. There is pollution in the parking buildings which is caused by the running of many car engines throughout the day.

5. Collisions occur between cars, columns and walls.

Currently available devices to increase parking capacity: In recent years, some devices have been created to increase parking capacity in urban areas.

1. Simple dual parking device: A simple dual parking device is a lifting device which lifts a first car up, close to the ceiling of the story, and leaves space below for a second car. This device almost doubles parking volume. However, the upper car is not easily accessible when the lower car is still there. Usually, the lower car owner must leave his car-key with the garage manager before leaving, so that the manager can move the lower car if he has to retrieve the upper one. Then the manager still has to park the lower car back in the space. This operation is time-consuming in a narrow and crowded driveway, and it often bars traffic in the parking garage.

2. Improved dual parking device (FIG. 1A): In this device, parking spaces are arranged in one row of N spaces; N usually being 3, 4, 5, or 6. The spaces are in two layers. In the upper layer, there are a total of N parking spaces, each equipped with a hanging car-pan that can carry the car up to its hanging parking position, or down to the ground as needed. The lower layer has one "empty space", and N-1 parking spaces, each equipped with a horizontally moveable pan. This moveable pan can move the lower cars so that the "empty space" is under the car the operator wants to retrieve. Obviously, the improved dual parking device satisfies the customer. However, customers must still drive their cars into the garage. Thus, this device only solves one of the five shortcomings which are discussed above.

3. Vertically moveable parking tower: To park more cars in a limited area, a vertically moveable parking tower is available (see FIG. 1B). In this tower, there are four large chain wheels arranged in a vertical fashion; two at the top, and two on the bottom. A specially designed chain is used to connect each pair of vertical wheels. A series of "car baskets" are hung on the two chains. Thus, by rotating the wheels, any "car basket" can be moved to the ground for loading or unloading cars. This solves several of the problems listed above. However, for structural reasons as shown in FIG. 1B, these "car baskets" cannot be arranged in a very compact vertical or horizontal manner. Also, this whole device is a very complex and expensive machine which consumes a lot of energy.

BRIEF SUMMARY OF THE INVENTION

This invention is entitled "Maximum auto-parking device" because, for the first time, the problems described above have been solved. Cars are automatically parked in an arrangement that maximizes the utilization of both the horizontal and vertical area. If you use this parking arrangement, there will be virtually no idle space left over; that's what is meant by "maximum."

The present device includes: a) a car-pan comprised of steel plate and including a stopping hole; b) strengthening rods on the car-pan; c) a parking space frame comprising a pair of steel C bars as its side beams and another pair of steel C bars as its end beams; d) free rollers with supports; e) driving rollers; f) a parking power/control box affixed between the two side beams of the parking space; g) chains connecting the driving rollers with the parking power/control box; h) an elevator; i) vertical rack-rails geared with the elevator; j) an elevator power/control box affixed between the two side beams of the elevator; and k) two pairs of chains connecting the driving rollers and the gears of the elevator power/control box. The present device preferably further includes: l) four cables with connectors, and m) two balance weights between the vertical rack-rails.

BRIEF DESCRIPTION OF THE SEVERAL VIEWS OF THE DRAWINGS

Sheet 1.

Figure 1A:
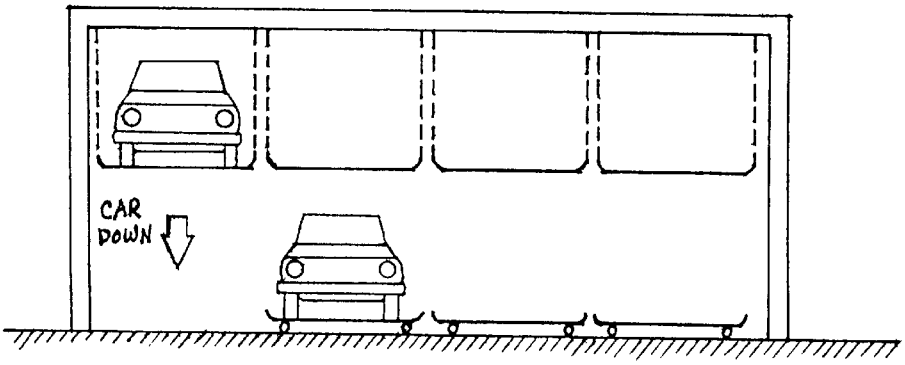
FIG 1A Prior Art
FIG. 1A Prior art: improved dual parking device
Figure 1B:
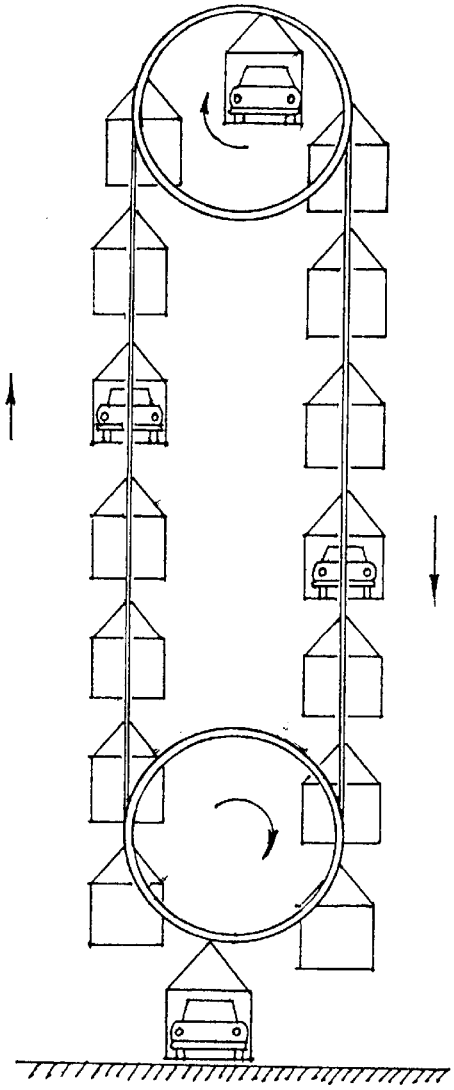
FIG 1B Prior Art
FIG. 1B Prior art: vertically moveable parking tower
Figure 2:
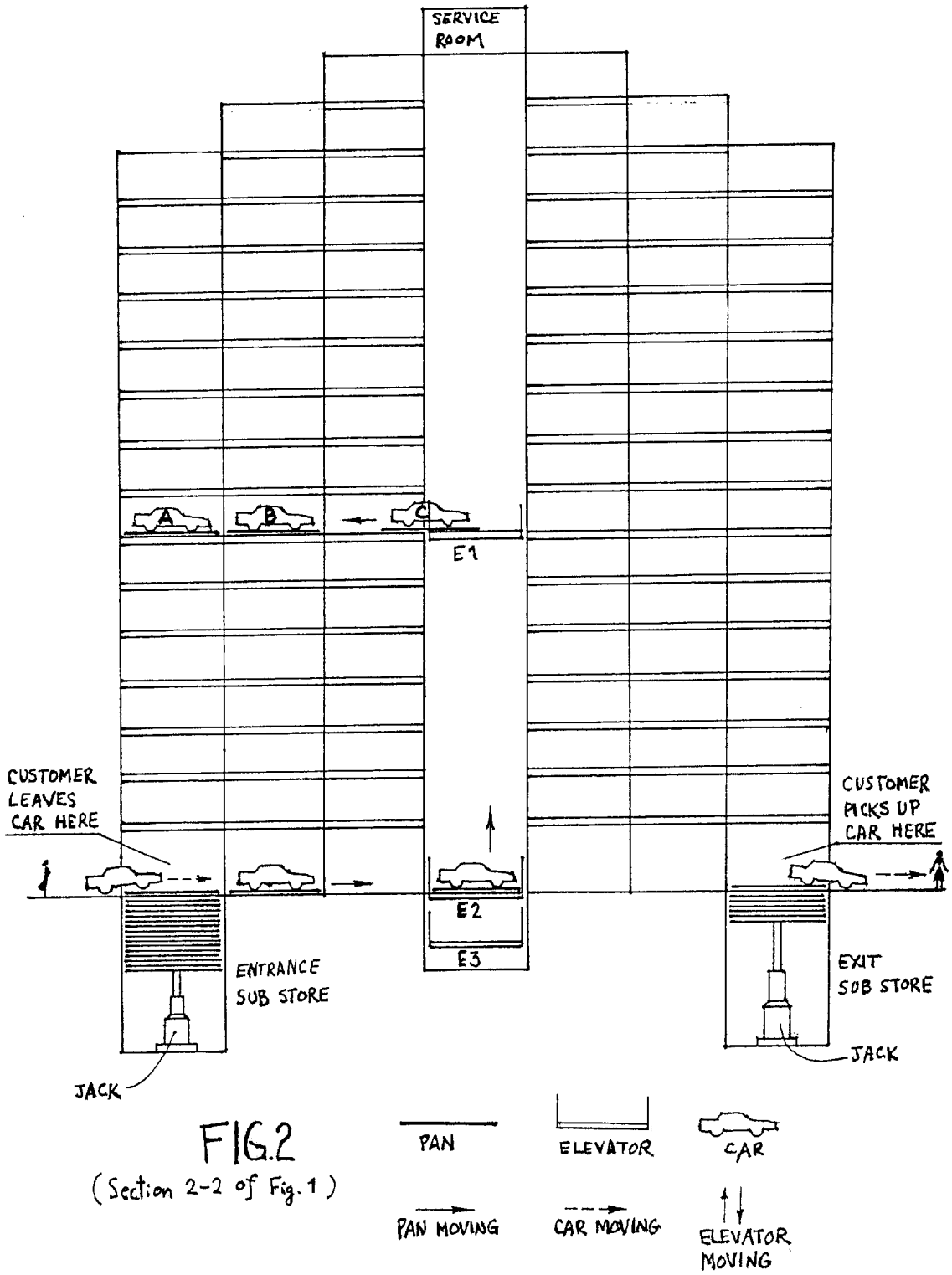
Figure 3:
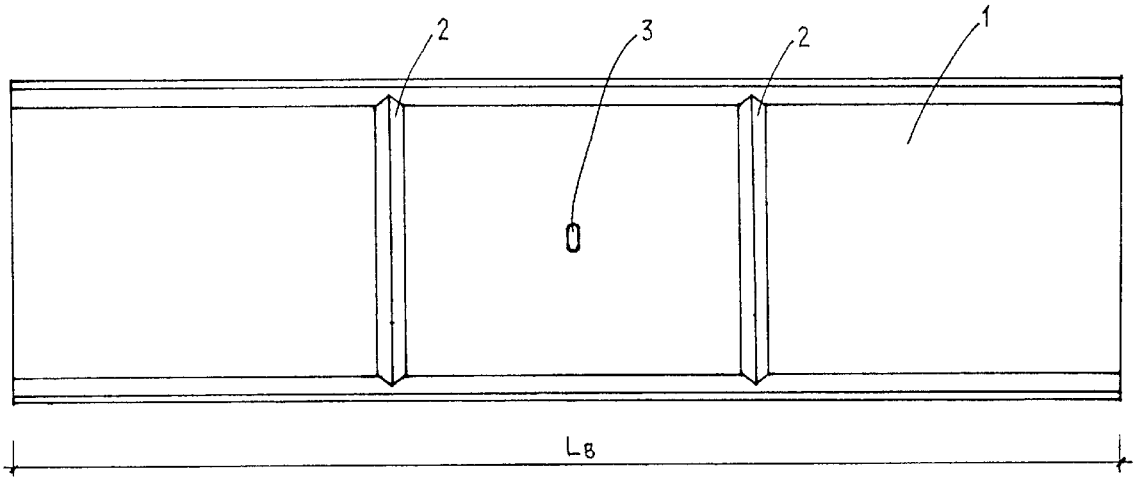

Sheet 2:

FIG. 1 Plan view of a maximum auto-parking device according to the present invention Sheet 3:

FIG. 2 Section 2—2 of FIG. 1 showing a vertical arrangement of parking spaces and parking processes Sheet 4:

FIG. 3 View showing a car-pan according to the present invention

Figure 4:
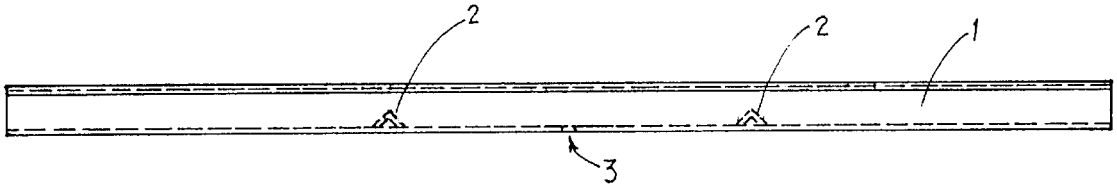
Figure 5:
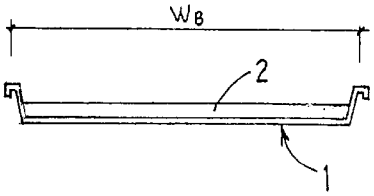
Figure 6:
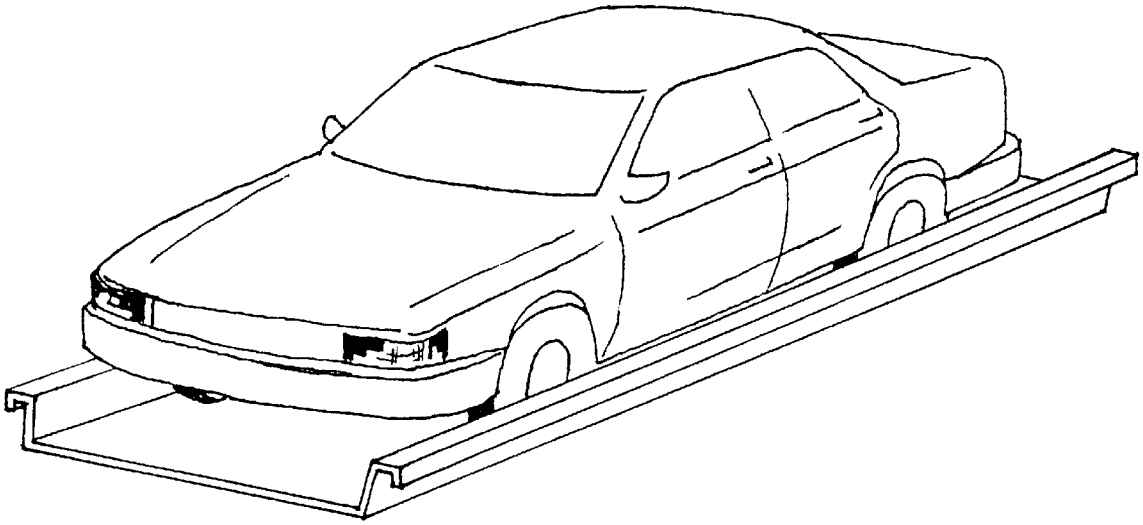
Figure 7:
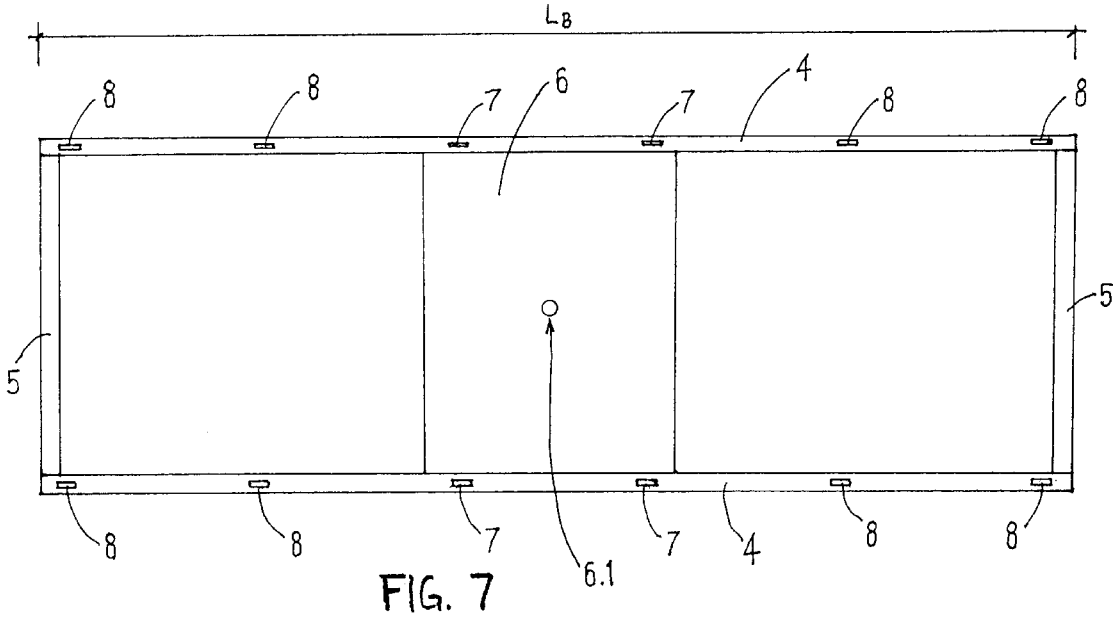
Figure 8:
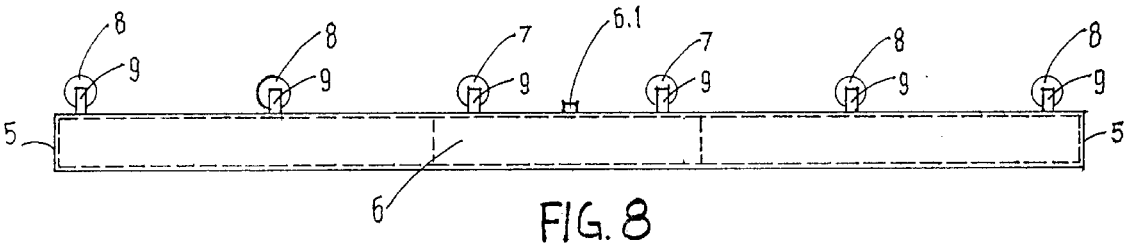
Figure 9:
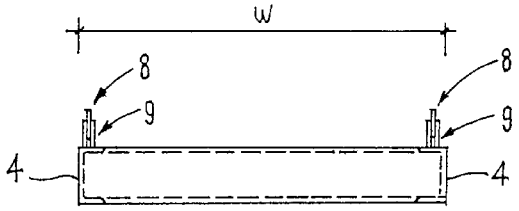
Figure 10:
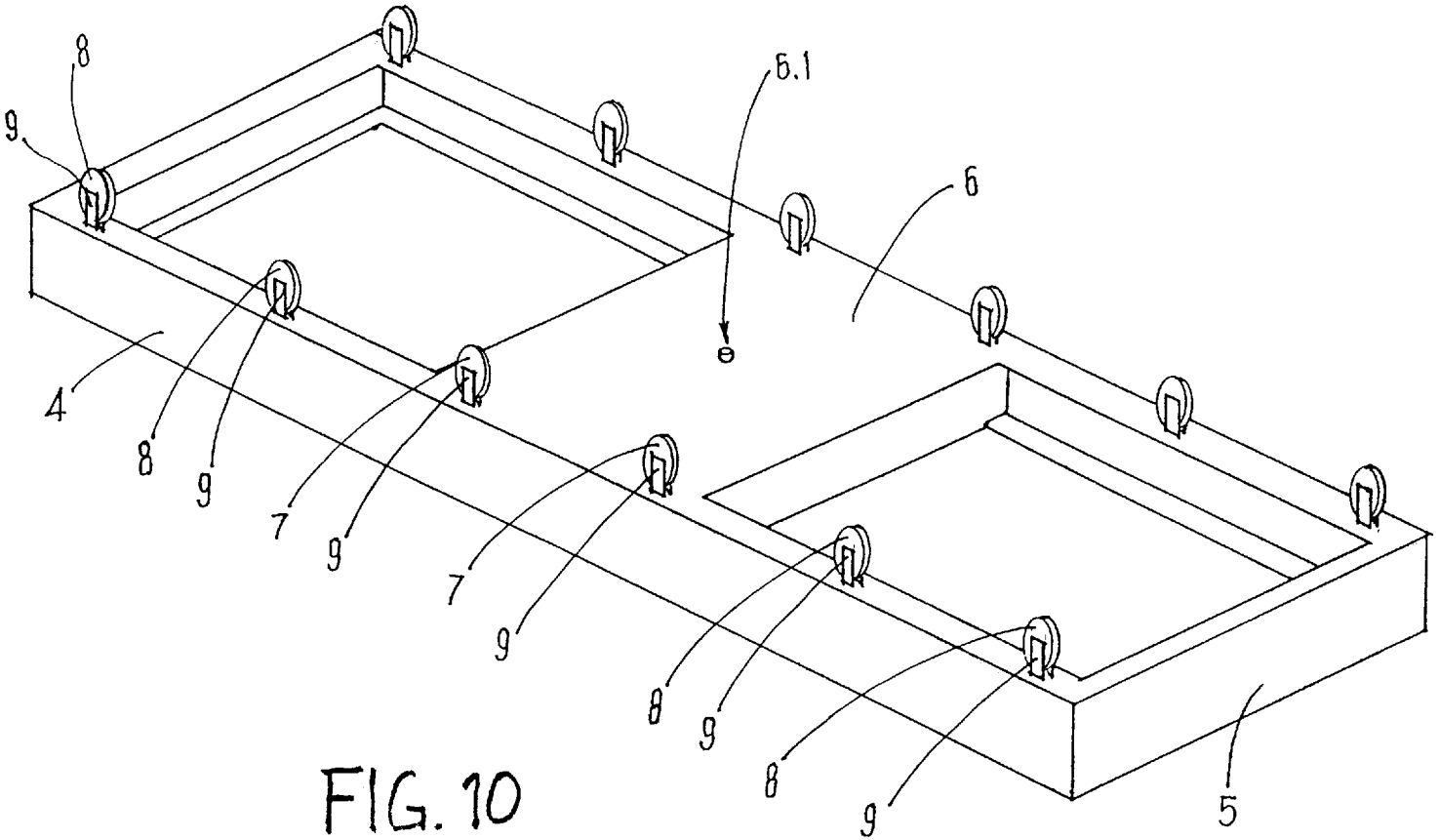
Figure 11:
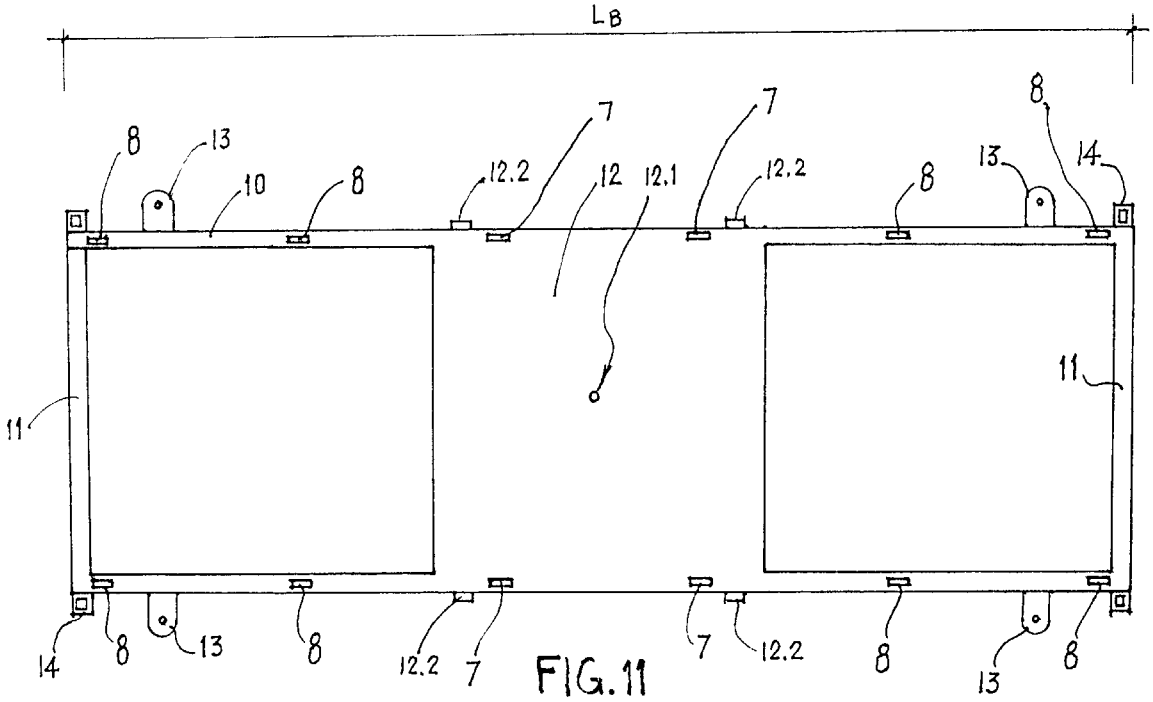

FIG. 4 View showing the side elevation of a car-pan according to the present invention FIG. 5 View showing the front elevation of a car-pan according to the present invention Sheet 5:

FIG. 6 Perspective view of a car-pan of the present invention carrying a car Sheet 6:

FIG. 7 Plan view showing a vehicle elevator according to the present invention FIG. 8 Side view of a standard parking space according to the present invention FIG. 9 Front view of a standard parking space according to the present invention Sheet 7:

FIG. 10 Perspective view of a standard parking space according to the present invention Sheet 8:

FIG. 11 Plan view of an elevator according to the present invention.

Figure 12:
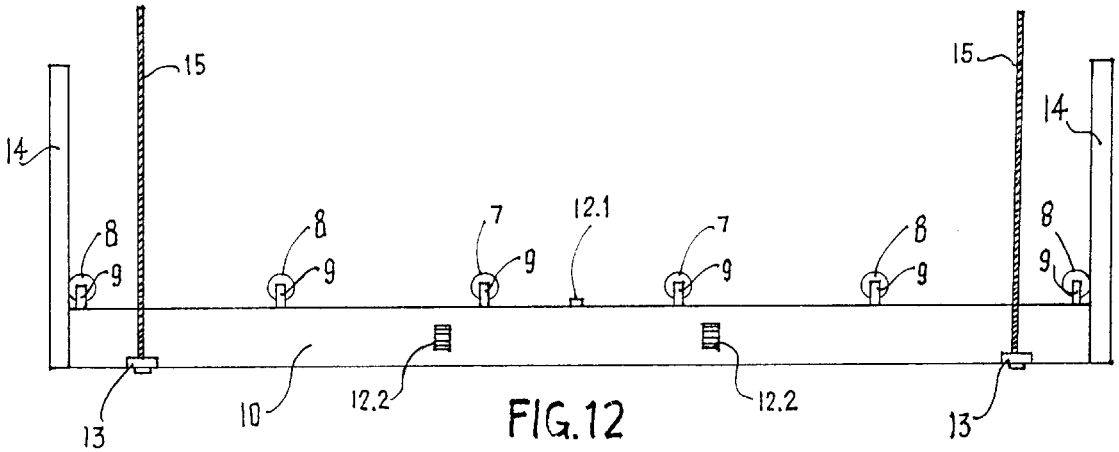

FIG. 12 Side elevational view of the elevator of FIG. 11

Figure 13:
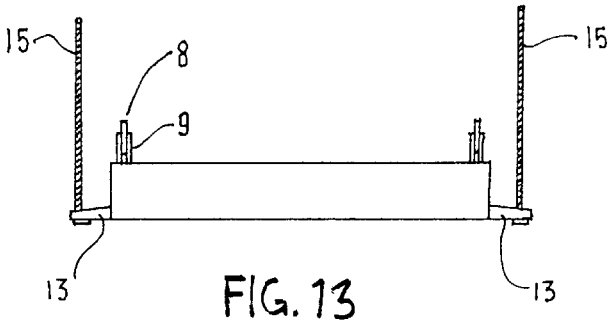

FIG. 13 Front elevational view of the elevator of FIG. 11

Figure 14:
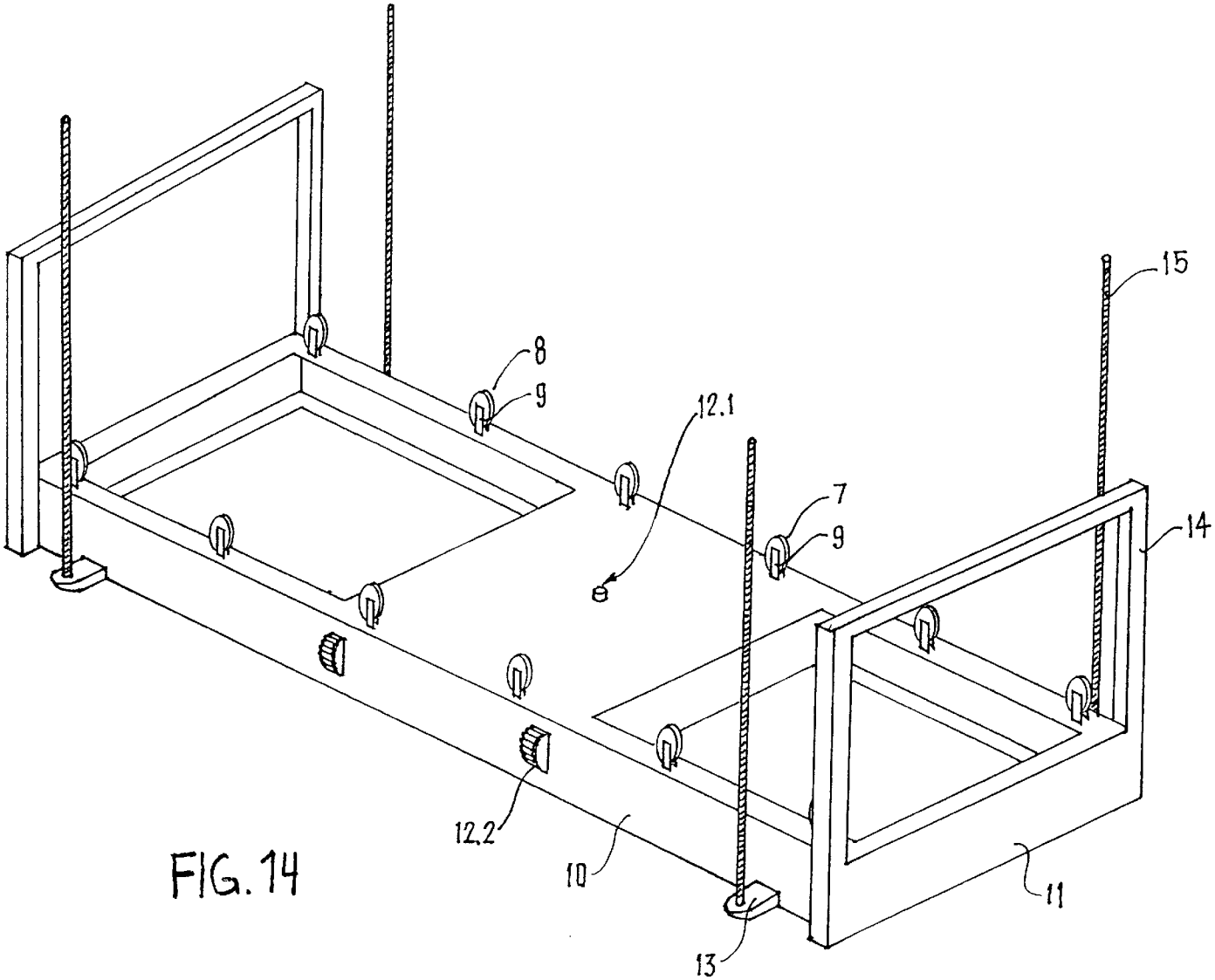
Figure 15:
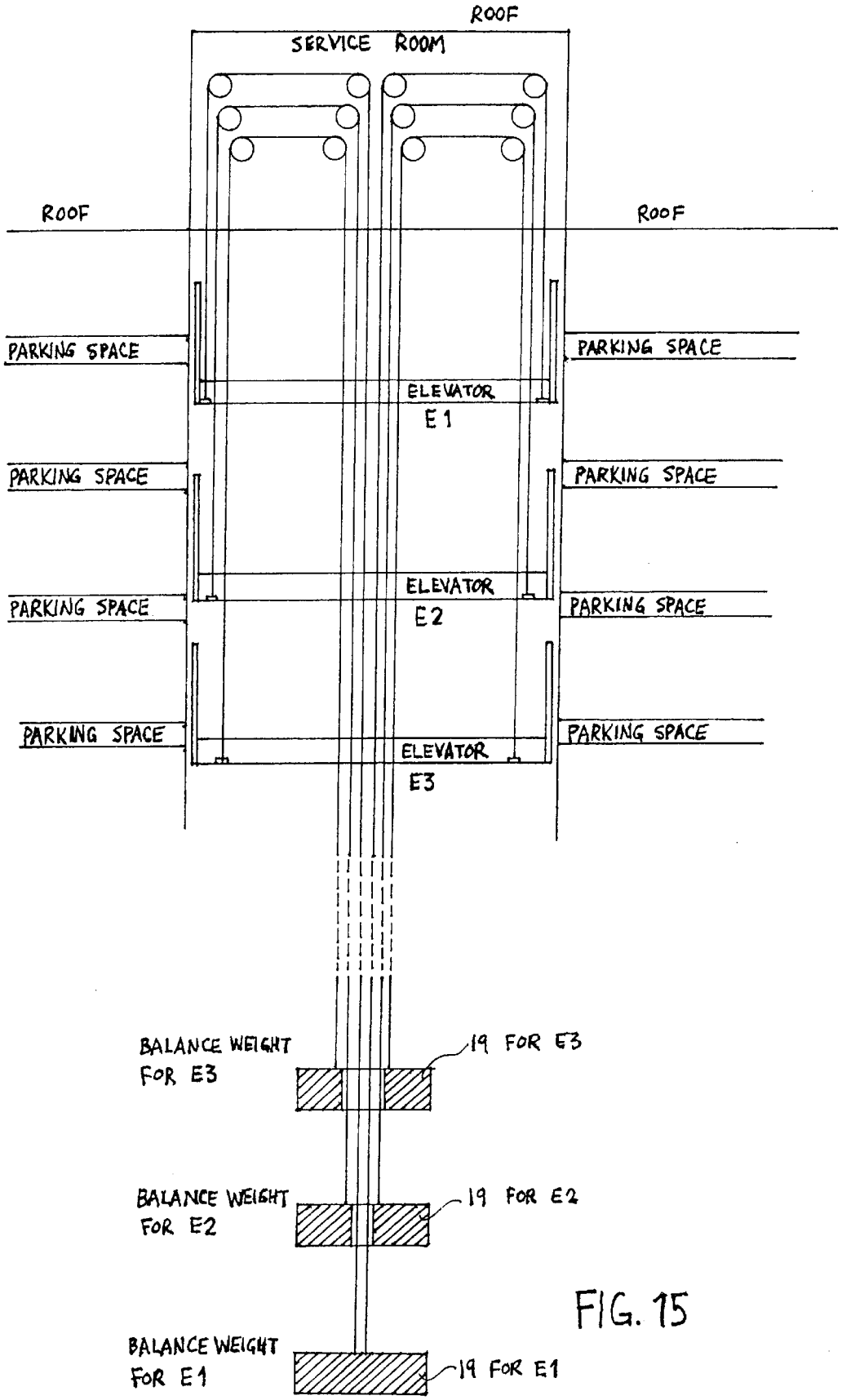

Sheet 9:

FIG. 14 Perspective view of a vehicle elevator according to the present invention Sheet 10:

FIG. 15 View of a balance weight arrangement for three elevators according to the present invention.

Figure 16:
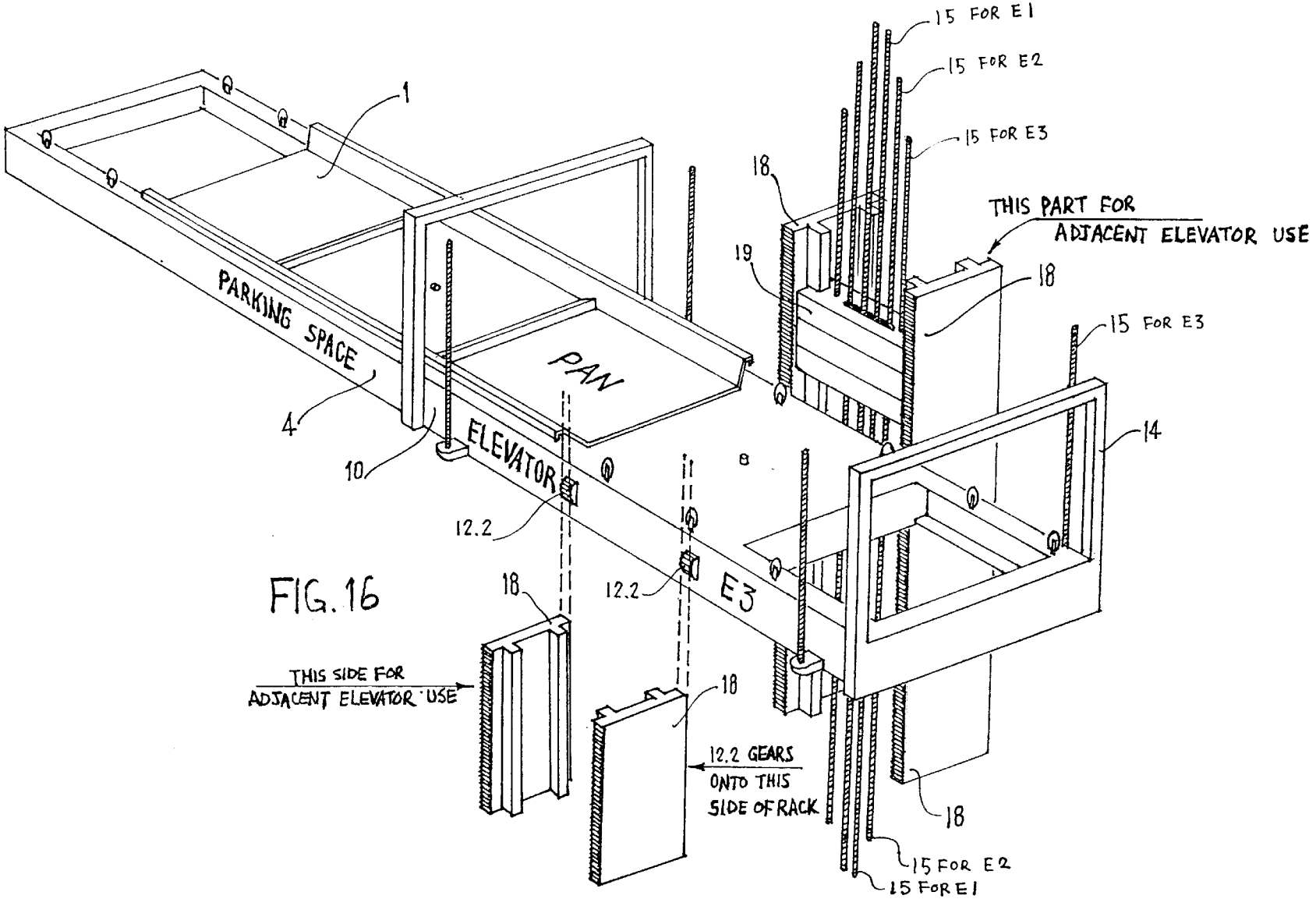

Sheet 11:

FIG. 16 Combined perspective of the invention

Figure 17:
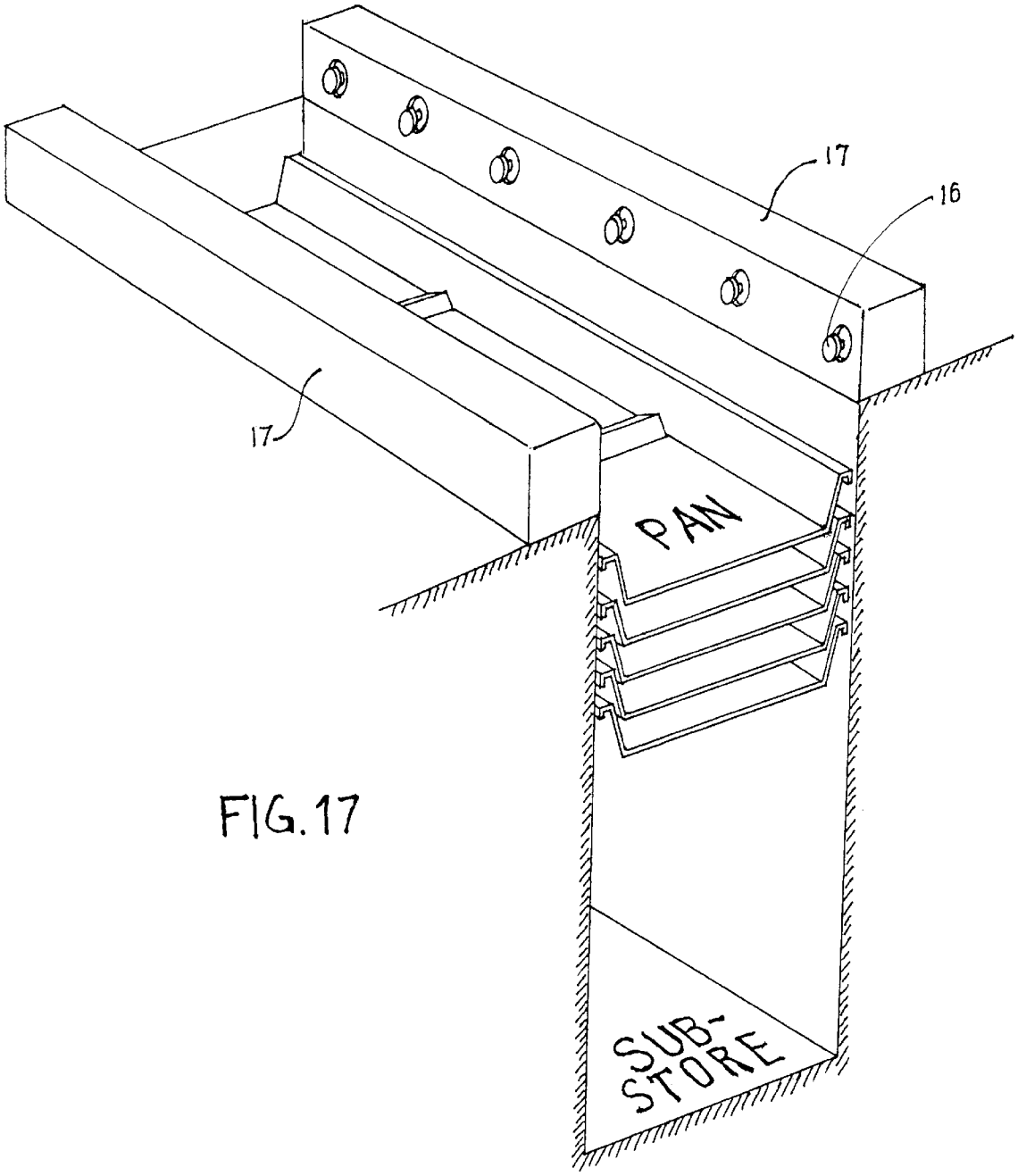

Sheet 12:

FIG. 17 Perspective view of the car-pan sub-store and its moveable rollers.

Figure 18:
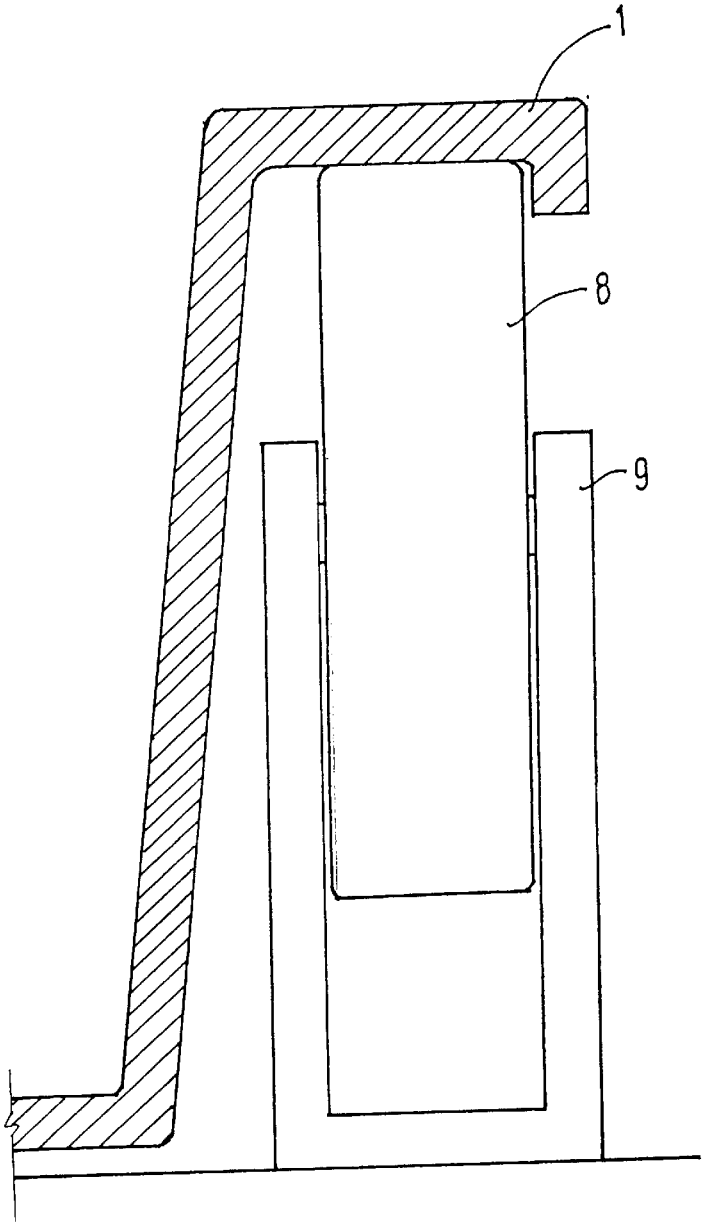

Sheet 13:

FIG. 18 View of a detailed pan and roller of the present invention

Figure 19:
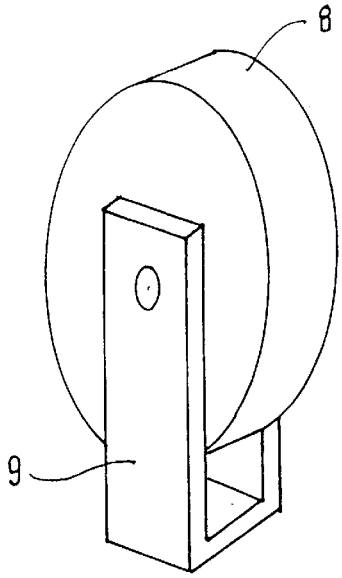

FIG. 19 Perspective view of a roller of the present invention

Figure 20:
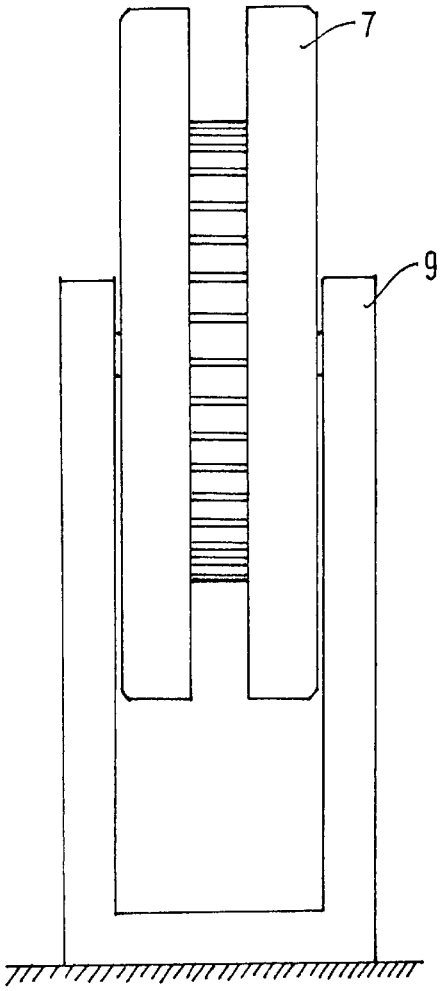

Sheet 14:

FIG. 20 View of a detailed driving roller of the present invention

Figure 21:
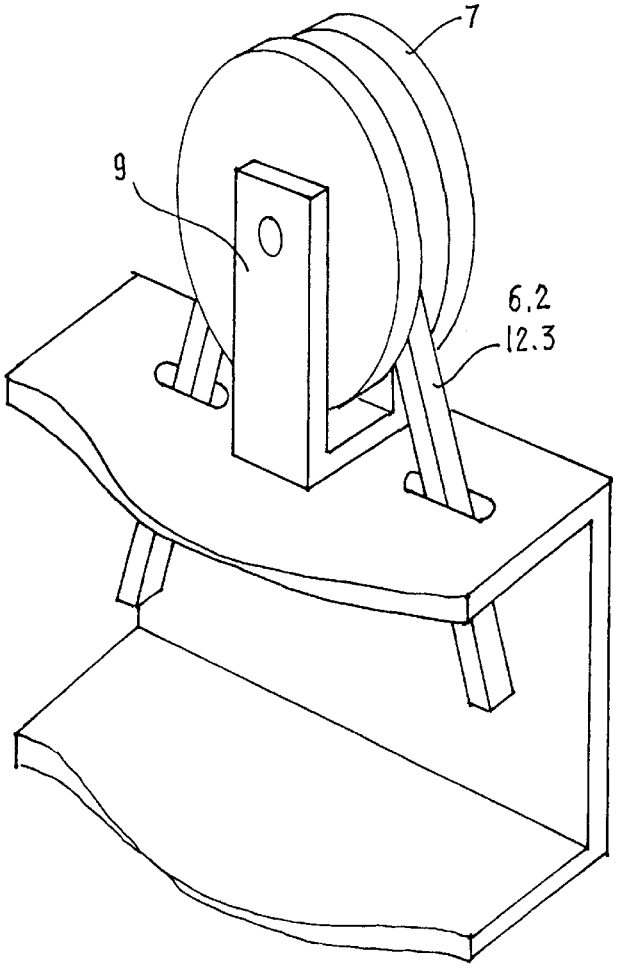

FIG. 21 Perspective view of a driving roller of the present invention

Figure 22:
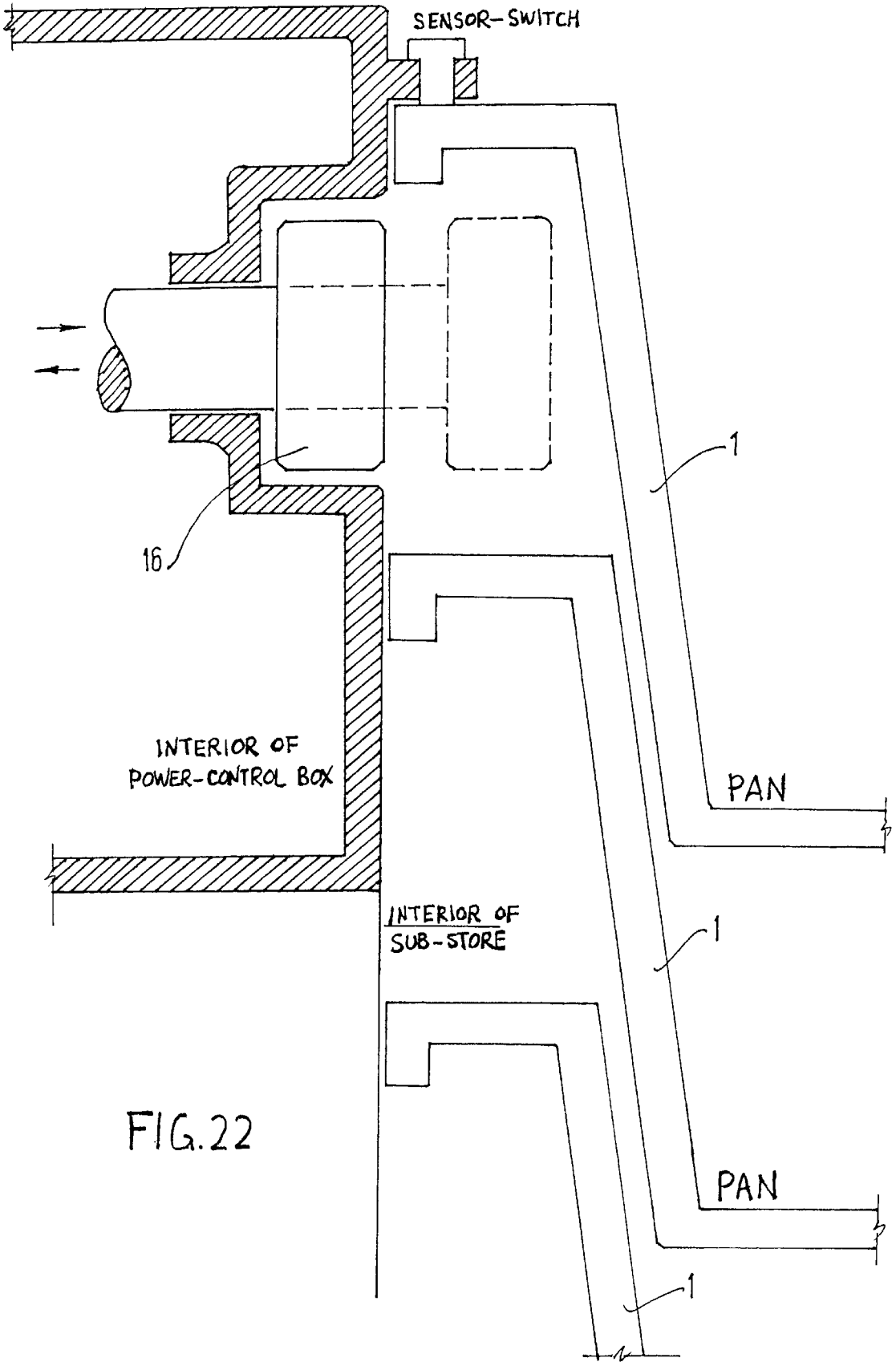
Figure 23:
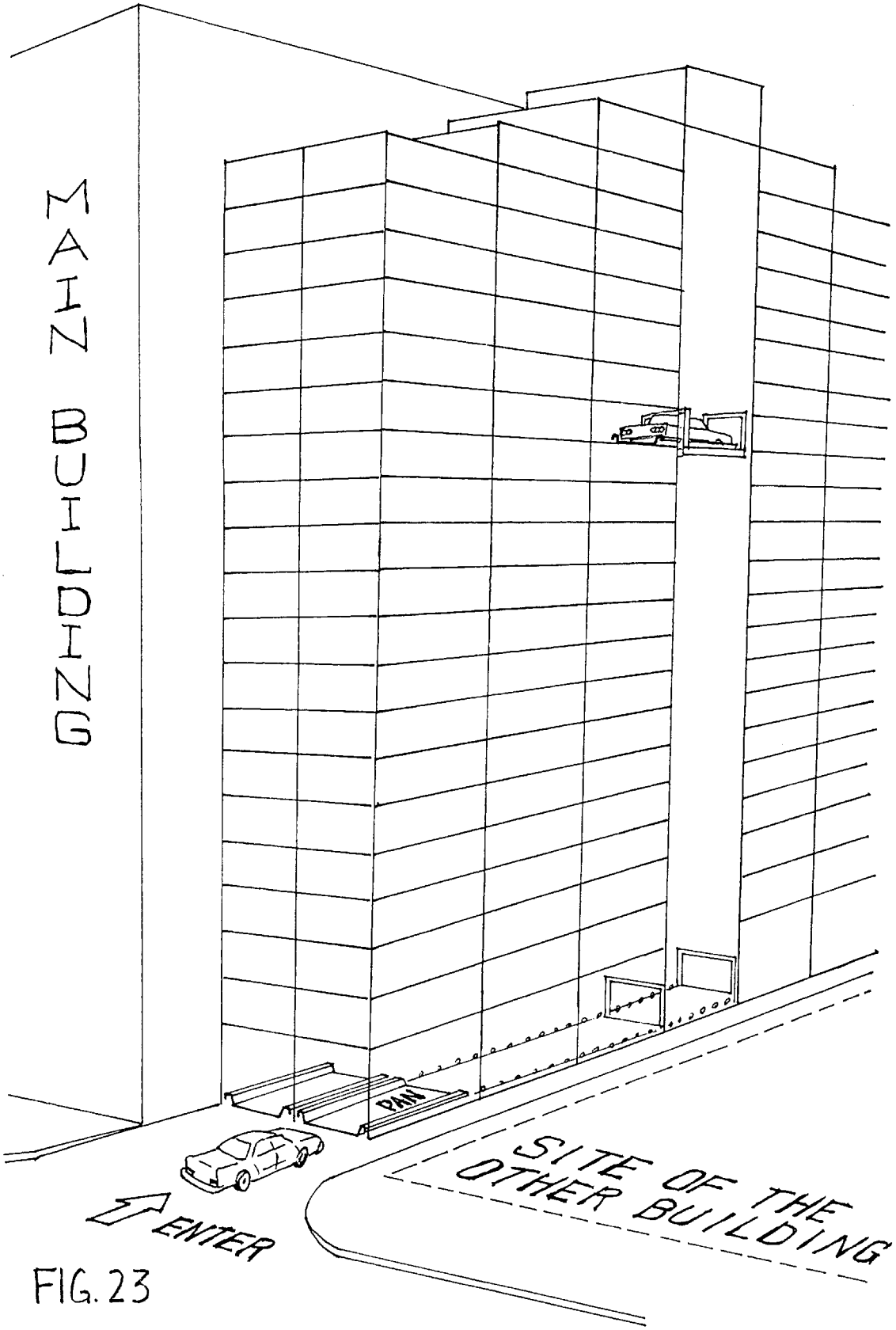

Sheet 15:

FIG. 22 View of a detailed moveable roller and a pan of the present invention Sheet 16:

FIG. 23 View of a device according to the present invention, shown in a narrow lane.

DETAILED DESCRIPTION OF THE INVENTION

The maximum compact parking space plan: As shown in FIG. 1, the present invention realizes a very compact parking space plan. Except for the central strip, which is occupied by elevators, the area shown in FIG. 1 can handle up to 12 rows and 6 columns (optional), thus providing 72 parking spaces. Cars can be parked here side by side and layer over layer. The parked cars are divided by necessary walkways. All driveways, ramps, stairways, passenger elevators, and dead comers are eliminated. The area directly used for parking is 6/7 of that of the floor. If the user increases the number of columns, the ratio of the area of the car-pan to the total area can be 8/9, which is even higher. That is about double the ratio of the traditional configuration.

Maximum compact parking in a vertical direction: FIG. 2, which is a view of section 2—2 in FIG. 1, shows a typical vertical arrangement of parking spaces and the related processes. Since the driver would not normally enter to park the vehicle, the height of each story is:

height of car+height of structure+gap (between the car and the structure). For vans and trucks, there could be a higher story available to provide more space. The vertical space utilization is about double that of the traditional parking facility.

The process of parking with this invention is shown in FIG. 2. The customer drives the car onto the "car pan" at the entrance, sets the brake, locks the door, and leaves. Driven by rollers, the car pan with the car on it moves onto the elevator and is lifted to a story that has a parking space available. The car pan is driven by rollers to its assigned parking space and is locked into position. By reversing this process, a car can be moved from the assigned parking space down to the exit for delivery to the customer.

Special Question: In parking so many cars in such a compact way, how can we move Car A, which is farthest from the elevator ("windowside") out, without moving Cars B and C down?

The present invention solves this question. In the present invention, parking proceeds as follows. In this embodiment, three elevators work cooperatively in one well.

a) The car-pan holding Car C loads itself onto Elevator E1.
b) Elevator E1 lifts Car C to the top of the elevator well.
c) The car-pan holding Car B loads itself onto Elevator E2.
d) Elevator E2 lifts Car B to the top of the elevator well (just below Car C).
e) The car-pan holding Car A loads itself onto Elevator E3.
f) Elevator E3 carries Car A down to the ground. (At the same time, Cars B and C are sent back to their original positions.)
g) The car-pan holding Car A carries it to the exit for pickup.

To access cars on the upper story, there is ordinarily only one empty space available at the top of the elevator well. This problem is solved by a terraced design in the parking facility of the present invention. To arrange four columns of parking spaces at both sides of the elevator well, the top stories should include a 4 step terraced design with four elevators working in the same well instead of three. An alternative to the preferred terraced design is to let two parking spaces be used as temporary spaces for holding the inner cars (e.g., Car B or Car C) while the car farthest from the elevator (e.g., Car A) is moved out.

For the first time, this invention implements multiple elevators working in the same elevator well simultaneously.

There is no doubt that all the process must be controlled by a computer. Without question, today's available computer technology can be employed. This invention does not attempt to address the computer technological requirements for operating this invention.

A preferred embodiment of this invention is shown in FIG. 1. FIG. 1 shows a typical floor plan for the second story and above. The ground floor is used for cars entering and exiting. The embodiment shown in FIG. 1 has 12 rows of 6 columns; for a total of 72 parking spaces on each layer. The parking lot of the present invention includes a "frame" or a "rack." However, the words "floor," "story," and "layer" may be used interchangeably herein.

The basic width of a parking space, WB, is defined as the distance between two central lines of two rows of rollers on each side of the parking space and elevator in the present invention. WB would be approximately 2 meters (80 inches), for example, if the parking facility is designed to accommodate mostly sedans. The width of the walkway between spaces is WG. In this example, WG could be 0.6 meters (24 inches) and the average length of a car-pan may be between 5.5 meters and 6.5 meters (220 inches to 260 inches). Here, this is also the average length of the parking spaces and the elevators. These dimensions may be adjusted according to the type of the majority of the cars which will be parked in the facility.

The number of rows shown in FIG. 1 could be increased or decreased according to the size of the field. The number of columns should ordinarily be 6 or 8; too many columns would slow down the parking process. If the field is large enough, a design that combines multiples of the typical plan shown in FIG. 1 would be acceptable. Appropriate buffer zones must be provided between this building and the street in compliance with city planning and traffic rules.

FIG. 2, which shows section 2—2 of FIG. 1, illustrates a typical vertical parking space arrangement of the present invention, as well as the process of parking and exiting using this arrangement. The ground level is the processing level above which there are, for this example, a total of 14–16 parking stories and one service room at the top. This section contains 90 parking spaces; thus our example has a total of 1,080 parking spaces available (90×12). Since the cars are automatically parked in a side by side and layer over layer arrangement, the use of space is maximized. That is why we refer to this invention as the "maximum auto-parking device." No idle space is left.

FIG. 2 also shows three elevators in one well with an elevator pit at the bottom of the well. Parking efficiency is dependent on the working efficiency of the elevator. During non-rush hours, the upper elevator (E1) can easily handle the volume, and the other elevators (E2 and E3) are standing by in the pit. When the parking facility is busy, E2 and E3 can be put into service with E1. Should the need arise, all three elevators can work together to retrieve a "blocked" car, as described above.

FIG. 2 also shows underground car-pan storage areas (the "sub-store"); one at the entrance to the facility, and another at the exit of the facility. Computer-controlled hydraulic jacks can be set at the bottom of the "sub-store" to lift stored pans up or move them down, one by one. The function of the store is for convenient car parking and exiting during rush hours.

The car-pan at the entrance, carrying its car, is driven by rollers onto the elevator. The elevator then lifts the car to its assigned parking level where it will be driven into its parking position. When the customer claims his or her car at the exit, the pan with its car will be driven onto the elevator. The elevator will lower the car-pan to the ground where it will be driven to the exit for the customer to pick-up. The parking lot's staff must collect all of the empty car-pans and move them into the entrance "sub-store" before rush hour begins. This ensures that there will be a full supply of pans; enabling customers to leave their cars one after the other. The staff must also move the car-pans from the exit "sub-store" so that they are empty before the afternoon rush hour. Thus, whever a car leaves, the pan can be lowered, leaving room for the next pan. In summary, the staff must move the pans from the exit sub-store to the entrance sub-store constantly. "Staff" requirements could easily be handled by a computer system, if available.

Moveable rollers [16], controlled by a pair of power/control boxes [17], are used to transfer the motion of the stored car-pans from vertical to horizontal and vice-versa. The moveable rollers are installed at ground level on the two sides of the "sub-store" as shown in FIG. 17. When a car-pan is needed at the ground level entrance, the moveable rollers will be retracted into the concave holes of the box; allowing the hydraulic jacks to raise the car-pan stack so the rollers fall between the top pan and the one directly beneath it. The rod of the car-pan [2] ensures that there will always be a gap of 10 centimeters between the pans when they are stacked vertically in a "sub-store." This "gap" allows enough clearance for the moveable rollers.

Once the stack of car-pans has been correctly positioned by the hydraulic jacks, the rollers are extended to their operating position, as indicated by the broken line in FIG. 22. Next, the hydraulic jack moves downward slightly, allowing the top car-pan to be supported by the rollers. The car-pan, with its car in place, can then be driven by rollers onto the elevator. The process can be repeated to move the next car-pan into position. To store a car-pan on the stack, the hydraulic jack lifts the stack until the jack supports the car-pan's weight. Next, the moveable rollers retract, allowing clearance for the jack to move the stack downward.

This example illustrates the arrangement and utilization of the present invention in a framed building above the ground. The present invention can also be used for underground parking. To do so, leave the ground floor and the two "sub-stores" shown in FIG. 2 unchanged. Move the parking space frame, the elevator well, and the pit to the underground area and move the service room to the second story. That is the basic idea of using the invention underground.

There is no major difficulty using this invention to increase the capacity of an existing multi-story parking facility. In this case, there are usually two parking stories on each floor rather than one. Openings on each floor must be created for the elevators. All the driveways and dead corners may be eliminated and used as extra parking spaces if the capacity of the building structure is sufficient. Since the load on each floor has been at least doubled, and some of the beams may have been weakened due to the openings cut for the elevators, the whole structure of the building must be checked and strengthened if necessary.

This invention is designed primarily for sedan parking in urban areas. To accommodate mini trucks and vans, the parking frame may need to be modified to increase the vertical spacing for some stories. This invention can also accommodate large motor vehicles simply by changing its basic dimensions.

This invention is particularly useful in areas like Manhattan. One or two "pieces" of the parking device can be placed in a driveway between two high-rise buildings. Since the device can accommodate many cars, the congestion caused by cars parking on the street will be reduced and traffic will move more easily. Since customers are more likely to visit areas with less traffic congestion, utilization of this device can lead to increased prosperity downtown.

FIG. 3 provides a view of a car-pan according to the present invention. The car-pan is the basic carrier of the car. Each parking space of the present device has a car-pan. The car-pan [1] comprises strengthening rods [2], and a stopping hole [3]. The length of the car-pan, or parking space, is LB.

In FIG. 4, a side elevation of a car-pan [1] is shown. The strengthening rods [2], and stopping hole [3] are shown.

In FIG. 5, a front elevation of the car-pan is provided. FIG. 5 includes a strengthening rod [2], with a width of WB.

FIG. 6 is a perspective view of a car in the standard car-pan. There is a downward groove along each of the two opposite edges of the car-pan. The downward grooves are so that the car-pan can be supported onto the rollers and moved.

FIG. 7 provides a plan view of the elevator, illustrating: [4] side beam of parking space, [5] end beam of parking space, [6] power/control box of parking space, [6.1] parking stopping pin at the top of [6], [7] driving roller, and [8] free roller. The length is LB, which is the length of the parking space.

In FIG. 8, [5] end beam of parking space, [6] power/control box of parking space, [6.1] parking stopping pin at the top of [6], [7] driving roller, [8] free roller, and [9] support of the roller, are shown.

FIG. 9 is a view of the standard parking space and includes: [4] side beam of parking space, [8] free roller, and [9] support of the roller. The width is W.

FIG. 10 provides a perspective view of a standard parking space according to the present invention, including: [4] side beam of parking space, [5] end beam of parking space, [6] parking power/control box, [6.1] parking stopping pin at the top of [6], [7] driving roller, [8] free roller, and [9] support of the roller.

FIG. 11 provides a plan view of the elevator, and includes: [7] driving roller, [8] free roller, [9] support of the roller, [10] side beam of elevator, [11] end beam of elevator, [12] elevator power/control box, [12.1] elevator stopping pin at the top of [12], [12.2] climbing gears at the two sides of [12], [13] elevator cable connector, and [14] safety frame of elevator. The length is LB, which matches the length of the car-pan.

As shown in FIG. 12, the elevator of the present invention includes: [7] driving roller, [8] free roller, [9] support of the roller, [10] side beam of elevator, [11] end beam of elevator, [12] elevator power/control box, [12.1] elevator stopping pin at the top of [12], [12.2] climbing gears at the two sides of [12], [13] elevator cable connector, [14] safety frame of elevator, and [15] elevator cable.

The front elevational view of the elevator in FIG. 13 includes: [8] free roller, [9] support of the roller, [13] elevator cable connector, and [15] elevator cable.

In FIG. 14, a perspective view of the elevator: [7] driving roller, [8] free roller, [9] support of the roller, [10] side beam of elevator, [11] end beam of elevator, [12] elevator power/control box, [12.1] elevator stopping pin at the top of [12], [12.2] climbing gears at the two sides of [12], [13] elevator cable connector, [14] safety frame of elevator, and [15] elevator cable are shown.

FIG. 15 shows the balance weights [19] arrangement for three elevators (E1–E3). Each balance weight is connected to its corresponding elevator by cables which are wound onto pulleys at the top of the elevator well. The cables of the lowest balance weight go through the center of the other two balance weights, and so forth.

FIG. 16 shows a combined perspective of the preferred embodiment of the invention, which includes a parking space, car-pan and elevator. Items [1] car-pan, [4] side beam of parking space, [10] side beam of elevator, [12.2] climbing gears at the two sides of [12], [14] safety frame of elevator, [15] elevator cable, [18] vertical rack-rail, and [19] balance weight of elevator are shown.

In regard to the power/control boxes, the parking power/control box [6] is preferably affixed between the side beams [4] and comprises a parking stopping pin [6.1] affixed at the top of the box. The parking stopping pin is pulled down to allow the car-pan to pass through while the car-pan is moving, and is released to extend up and insert into the stopping hole [3] of the car-pan while the car-pan is parked. The elevator power/control box [12] is preferably affixed between the side beams [10] and comprises a stopping pin which is [12.1] affixed to the top of the elevator power/control box. The elevator stopping pin is pulled down to allow the car-pan to pass through while the car-pan is moving, and is released to extend up and insert into the stopping hole [3] of the car-pan while the car-pan is in a parked position (i.e. parked or stopped). Preferably, two pairs of roller power/control boxes [17], each comprising six moveable rollers for each, are affixed onto ground level and at the two sides of both the entrance sub store and the exit sub store.

In FIG. 17, the moveable rollers [16] can be retracted to allow the pan to be raised into position, or to be lowered into the sub-store. When the rollers are extended, they support the car-pan and also drive it.

FIGS. 18 and 19 show a detailed pan and roller, and a perspective view of the roller, respectively. A car-pan [1], [8] free roller, and [9] support of the roller are shown.

FIGS. 20 and 21 show a detailed driving roller, and a perspective view of the driving roller, respectively. A driving roller [7], [9] support of the roller, and [6.2/12.3] chain to drive the driving rollers are shown.

FIG. 22 is a view of a detailed moveable roller [16] and a car-pan [1] of the present invention.

FIG. 23 illustrates how the present invention might be used in a narrow field between two high-rise buildings. In addition, a new building which has this invention attached to its side has no need for a large, deep basement.

As described above, a practical maximum auto-parking device includes a number of car-pans; same number of parking spaces; another number of elevators; related building structure including the sub-stores, and the desired control systems and processes.

This invention comprises: a car-pan as the car carrier; a parking space with powered rollers to move or park the pan; an elevator with powered rollers, and other accessories to hold and move the pan vertically and horizontally. With the suggested arrangement and method of use, a multistory maximum parking lot can be provided which offers parking spaces about four times greater capacity than current multistory parking lots with the same total space (Length times Width times Height). This invention parks cars automatically from entrance to exit, which results in time savings for customers. Additionally, pollution from engines and collisions are avoided.

What is claimed as new and desired to be protected by letters patent is set forth in the appended claims:

1. A maximum auto-parking device, comprising:

a) a car-pan comprised of steel plate;

b) a stopping hole on said car-pan;

c) two strengthening rods on said car-pan;

d) a parking space frame comprising a pair of steel C bars as its side beams and another pair of steel C bars as its end beams;

e) a number of free rollers with supports; said free rollers being affixed onto the upper surfaces of said side beams of said parking space;

f) two pairs of first driving rollers with supports; said first driving rollers being affixed onto the upper surfaces of said side beams of said parking space;

g) a parking power/control box affixed between said two side beams of said parking space; said parking power/control box comprising a parking stopping pin affixed at the top of said box;

h) two pairs of chains connecting said first driving rollers with said parking power/control box;

i) an elevator comprising a pair of steel C bars as its side beams and another pair of steel C bars as its end beams;

j) two pairs of vertical rack-rails geared with said elevator;

k) two pairs of second driving rollers with supports; said second driving rollers being affixed onto the upper surfaces of said side beams of said elevator;

l) an elevator power/control box affixed between said two side beams of said elevator; said elevator power/control box comprising an elevator stopping pin and two pairs of climbing gears;

m) two pairs of chains connecting said second driving rollers to said elevator power/control box;

n) four cables with connectors; said cables being affixed at one end to said side beams of said elevator; and o) two balance weights between said vertical rack-rails; said balance weights being connected to the other end of said cables.

2. A device according to claim 1, wherein said car-pan further comprises two downward grooves.

3. A device according to claim 2, wherein two strengthening rods are welded onto said car-pan to provide extra strength and stiffness for said car-pan and extra stability for the carried car.

4. A device according to claim 3, wherein two rows of said free rollers are aligned in two horizontal lines.

5. A device according to claim 4, wherein said two pairs of first driving rollers are aligned in two horizontal lines.

6. A device according to claim 5, wherein said parking stopping pin is affixed to the top of said parking power/control box.

7. A device according to claim 6, further comprising switches, gears, motor, and fuses to drive said second driving rollers.

8. A device according to claim 7, wherein the side and end beams of the elevator form a frame having a length and width equal to that of the car pan.

9. A device according to claim 8, wherein said two pairs of said second driving rollers with said supports; are aligned in two horizontal lines.

10. A device according to claim 9, wherein said elevator stopping pin is affixed to the top of said elevator power/control box.

11. A device according to claim 10, further comprising a pair of safety frames; said safety frames being affixed to two ends of said elevator.

12. A device according to claim 11, wherein said climbing gears are affixed at the two sides of said elevator power/control box and geared onto said two pairs of vertical rack-rails.

13. A device according to claim 12, wherein said four cables are wound onto pulleys to balance the weight of said elevator.

14. A device according to claim 13, further comprising two pairs of roller power/control boxes; each of said roller power/control boxes comprising six moveable rollers.

* * * * *